US006361209B1

(12) United States Patent
LaRue et al.

(10) Patent No.: US 6,361,209 B1
(45) Date of Patent: Mar. 26, 2002

(54) HANDLE BAG WITH CLOSURE

(75) Inventors: Jon M. LaRue, Fairport; Craig E. Cappel, Pittsford; Michael E. Marcuccilli, Geneva, all of NY (US)

(73) Assignee: Pactiv Corporation, Lake Forest, IL (US)

( * ) Notice: Subject to any disclaimer, the term of this patent is extended or adjusted under 35 U.S.C. 154(b) by 0 days.

(21) Appl. No.: 09/616,302

(22) Filed: Jul. 14, 2000

(51) Int. Cl.[7] ..... B65D 33/08

(52) U.S. Cl. ..... 383/10; 383/63; 383/64; 383/104; 383/120; 383/67

(58) Field of Search ..... 383/9, 10, 41, 383/63, 104, 120, 906, 64, 67

(56) References Cited

U.S. PATENT DOCUMENTS

| | | | | |
|---|---|---|---|---|
| 3,202,559 A | | 8/1965 | Laguerre | |
| 3,337,117 A | * | 8/1967 | Lehmacher et al. | 383/202 X |
| 4,573,203 A | | 2/1986 | Peppiatt | |
| 4,736,450 A | | 4/1988 | Van Erden et al. | |
| 5,080,497 A | * | 1/1992 | Peppiatt | 383/9 X |
| RE34,117 E | | 10/1992 | Martin et al. | |
| 5,167,608 A | | 12/1992 | Steffens, Jr. et al. | |
| 5,417,040 A | | 5/1995 | Davoren | |
| 5,419,437 A | * | 5/1995 | Huseman | 383/9 X |
| 5,480,230 A | * | 1/1996 | May | 383/9 |
| 5,529,394 A | | 6/1996 | Davoren | |
| 5,709,479 A | * | 1/1998 | Bell | 383/906 X |
| 5,938,337 A | | 8/1999 | Provan et al. | |
| 6,071,011 A | * | 6/2000 | Thomas et al. | 383/104 X |
| 6,213,641 B1 | * | 4/2001 | Price | 383/64 X |

FOREIGN PATENT DOCUMENTS

| | | | | |
|---|---|---|---|---|
| DE | 3119179 | * | 12/1982 | 383/906 |
| EP | 0416194 | * | 3/1991 | 383/67 |
| GB | 002254065 A | * | 9/1992 | 383/120 |
| JP | 0240650 | * | 10/1991 | 383/63 |
| JP | 0240651 | * | 10/1991 | 383/63 |
| JP | 405147661 A | * | 6/1993 | 383/63 |
| WO | WO-092021582 A1 | * | 12/1992 | 383/120 |

* cited by examiner

*Primary Examiner*—Jes F. Pascua
(74) *Attorney, Agent, or Firm*—Jenkens & Gilchrist

(57) ABSTRACT

A handle bag with a slider closure includes front and back panels sealed along the sides and a gusset top and bottom. A mouth is provided in the bag and a closure that includes a slider is secured to the mouth for opening and closing the mouth. A header is on the bag and provides a platform for equipment that fills and seals the bag. Handles may be provided in the header.

20 Claims, 4 Drawing Sheets

HANDLE BAG WITH CLOSURE

FIELD OF THE INVENTION

The present invention generally relates to reclosable handle bags and, more particularly, to gusseted handle bags with slider closures.

BACKGROUND OF THE INVENTION

Many manufacturers and retailers use plastic bags for packaging their products. Preferably, these bags are made of a material on which graphics may be applied. It is desirable the bag include gussets since a gusseted bag can stand rather than lay on a store shelf. It is also preferred that bags of this type be reclosable after opening. One resealable device that has been used with this type of bag is a zipper that is opened and closed by a slider. These bags are sold to product manufacturers and retailers who top or bottom fill these bags with product using filling and sealing machines. Traditionally, these bag customers were required to change their sealing equipment and possibly their filling equipment to accommodate the zippers and sliders. It is desirable to provide a gusseted bag with a resealable bag closure that does not require changes to bag filling and sealing equipment. Since bags of this type are often large and thus heavy when full, it is desirable that handles be provided on the bags.

SUMMARY OF THE INVENTION

The present invention provides a gusseted handle bag with a slider closure. This bag may be imprinted with attractive graphics and will stand up on a store shelf The slider closure allows the bag to be opened and closed preserving the contents of the bag from any adverse effects due to air and outside debris.

The bag of the present invention includes a header in which handles may be formed without requiring additional pieces to be added to the bag. The header may be imprinted with graphics providing a banner for advertising. The header also serves as a platform for existing customer filling and sealing equipment that minimizes any modifications that have to be made in order for this equipment to accommodate the bags of the present invention. The bag of the present invention can be used for a wide variety of flexible packaging needs in top or bottom fill applications.

BRIEF DESCRIPTION OF THE DRAWINGS

Other objects and advantages of the invention will become apparent upon reading the following detailed description and upon reference to the drawings in which.

Figure 1:
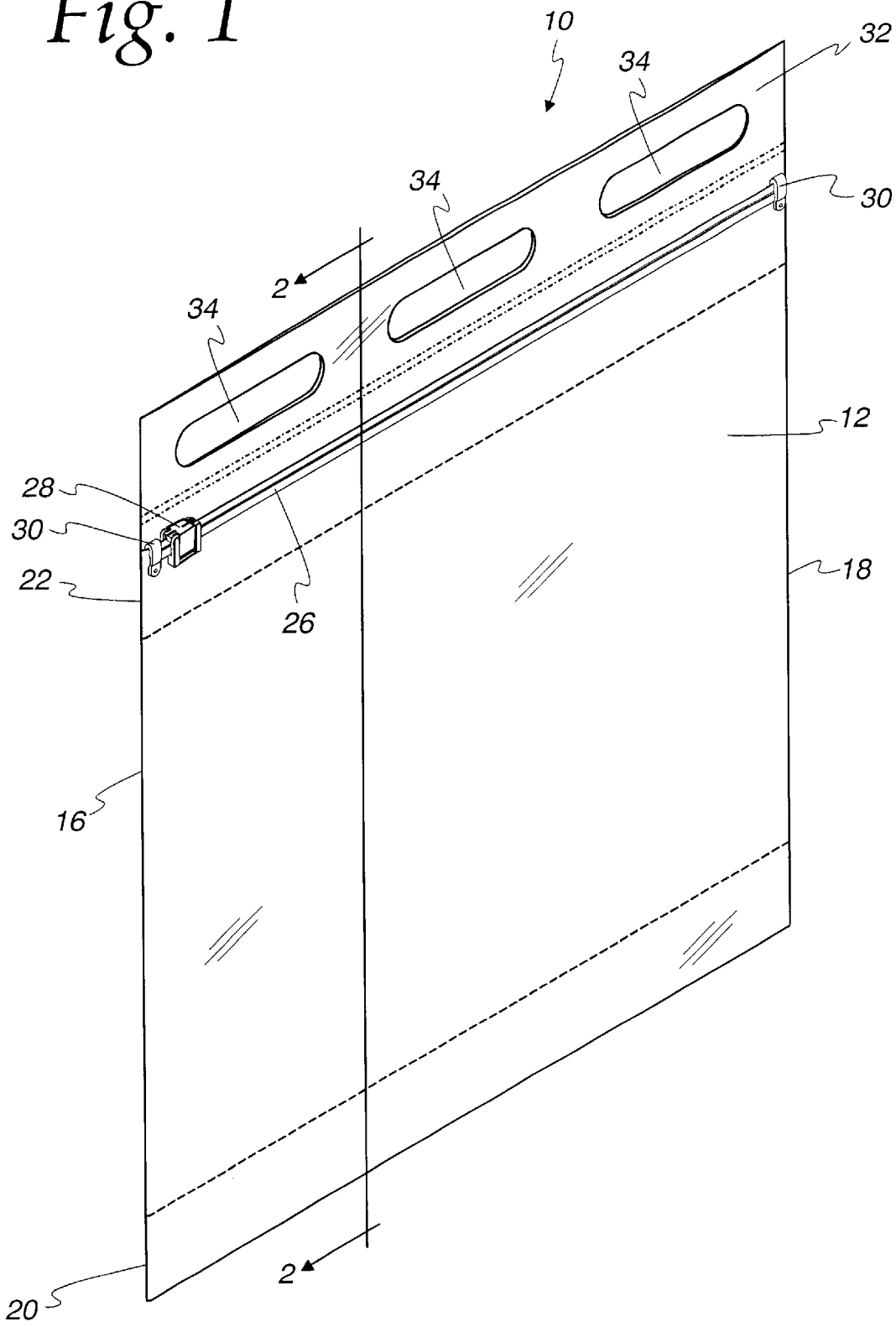
FIG. 1 is a perspective view of a bag constructed in accordance with the principles of the present invention.

While the invention is susceptible to various modifications and alternative forms, a specific embodiment thereof has been shown by way of example in the drawings and will herein be described in detail. It should be understood, however, that it is not intended to limit the invention to the particular forms disclosed, but on the contrary, the invention is to cover all modifications, equivalents, and alternatives falling within the spirit and scope of the invention as defined by the appended claims.

DETAILED DESCRIPTION OF THE PREFERRED EMBODIMENTS

Figure 2:
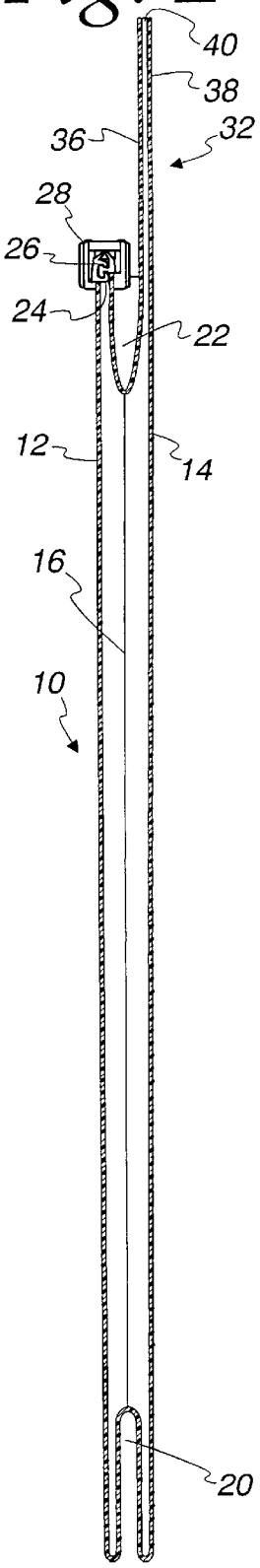
FIG. 2 is a view taken along line 2—2 in FIG. 1.

Referring initially to FIGS. 1 and 2, a bag 10 constructed in accordance with the principles of the present invention is illustrated. The bag 10 is defined by a front panel 12 and a back panel 14. The front panel 12 and back panel 14 may be a tube of film, a single piece of film folded over itself or it may be two or more sheets of film joined together. In the embodiment illustrated, the front panel 12 and back panel 14 are sealed together at sides 16 and 18 and a bottom gusset 20 is formed at the lower end of the front panel 12 and back panel 14. The bottom gussett 20 includes two peaks 20A and 20B (FIGS. 2–9) each being of approximately the same height. When the bag 10 is filled with a product, the bottom gusset 20 expands to provide a square bottom for more stable palletizing and allowing the bag 10 to stand on a shelf.

The bag 10 also includes a top gusset 22 at the upper end of the bag 10. The top gusset 22 inludes a first, short peak 22A and a second, tall peak 22B (FIGS. 2–9). The top gusset 22 with the bottom gusset 20 provides a more square bag 10 which is good for palletizing. A mouth 24 is formed at an upper portion of the first peak 22A of the top gusset 22 which allows access into the interior of the bag 10. A reclosable zipper or closure 26 is secured in the mouth 24. The closure 26 is opened and closed by a slider 28 that is mounted on and slides along the closure 26. Travel of the slider 28 is confined to the closure 26 by end termination clips 30 secured to opposite ends of the closure 26; however, the clips 30 do not need to be included. For example, the ends of the closure 26 may be welded to form a stop or termination for the slider 28. The closure 26 and slider 28 are of the type described in U.S. Pat. Nos. 5,007,143 and 5,067,208 and these patents are incorporated by reference herein. The closure 26 and slider 28 allow the mouth 24 to be opened so that some of the product in the bag 10 can be removed. After removal of some of the product, the mouth 24 can be closed thereby minimizing the exposure of the product remaining in the bag 10 from the outside environment.

The closure 26 and the slider 28 require modifications of bag filling and sealing equipment to accommodate this structure. Since it is desirable not to have to modify existing equipment, the bag 10 includes a header 32 that extends above the closure 26 and slider 28 and provides a platform for existing filling and sealing equipment to operate without requiring significant modification to the equipment. Instead of griping the bag 10 along the closure 26 and over the slider 28, the filling and sealing equipment grip the thin header thus avoiding making modifications to the equipment to accommodate the bulk of the closure 26 and slider 28. The header 32 also provides a banner for advertising and may include handles 34 that assist in carrying the bag 10.

Figure 3:
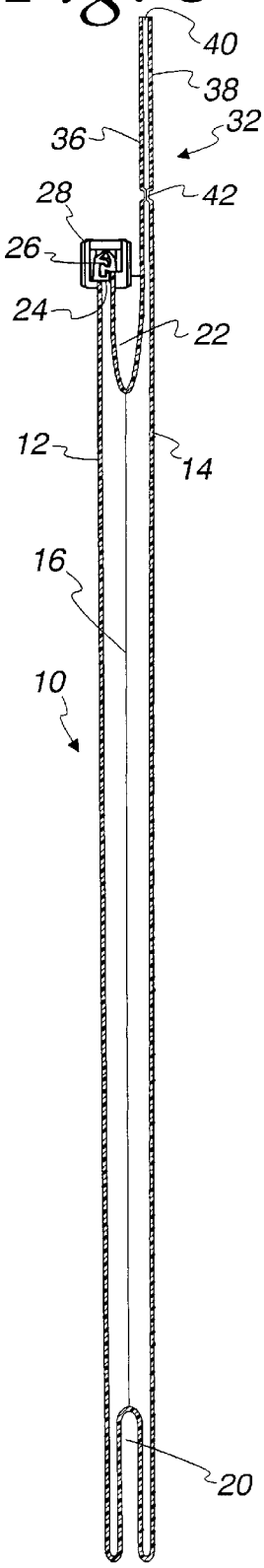
FIG. 3 is a view similar to FIG. 2 illustrating a seal in the bag after top filling.

The header 32 is on the second peak 22B of the top gusset 22 and includes a front panel 36 and a back panel 38. The back panel 38 is an extension of the back panel 14 of the bag 10. In the embodiment illustrated in FIG. 2, the header 32 and second peak 22B are open at the top 40. The bag 10 is filled with product through the open top 40 of the header 32. Once the bag 10 is filled, the header 32 is sealed at seal 42 (FIG. 3). Once sealed and filled, the bag 10 is easily palletized and can stand on a store or home shelf or on a floor. Access to the contents of the bag 10 is through the mouth 24, and the contents remaining in the bag 10 after opening can be preserved by closing the mouth 24 using the closure 26 and slider 28.

Figure 4:
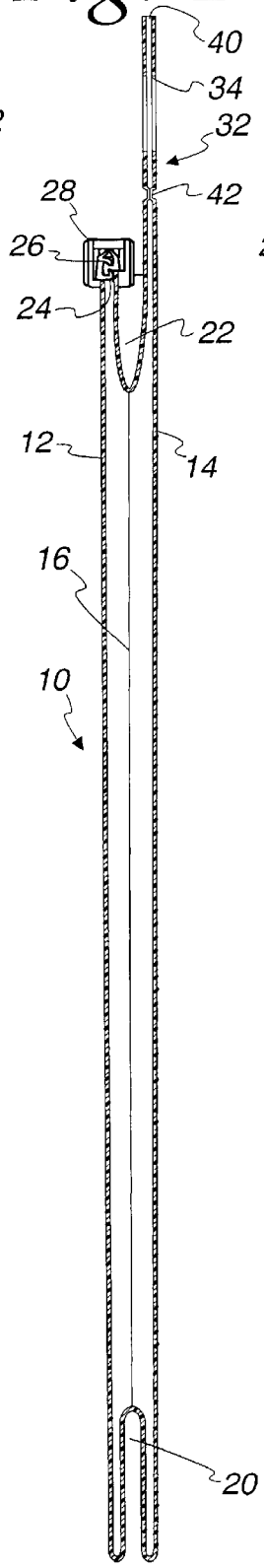
FIG. 4 is a view similar to FIG. 2 illustrating a handle and a seal in the bag after top filling.
Figure 5:
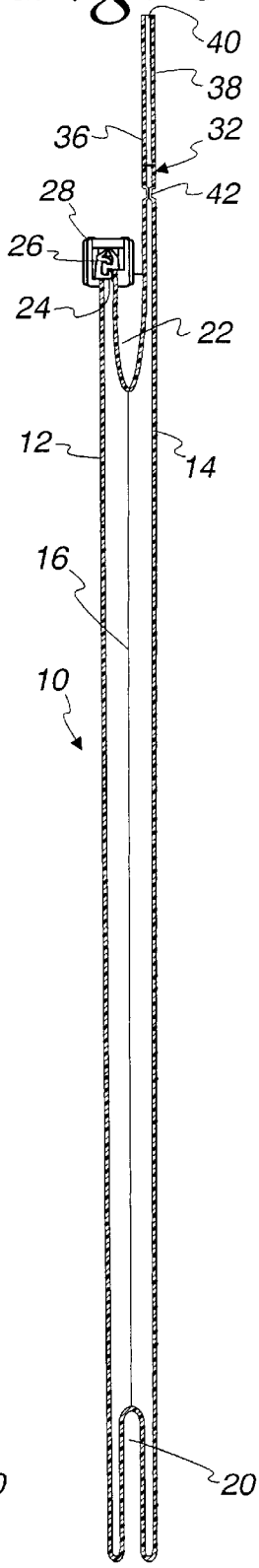
FIG. 5 is a view similar to FIG. 2 illustrating a seal in the bag after top filling and a line of weakness to remove a header.

As previously described, the bag 10 may also include handles 34 that are punched or cut in the header 32. As illustrated in FIG. 4, the handles 34 are formed in the header 32 above the seal 42, but the seal 42 can also be above the handles 34 or in the top 40 of the header 32.

In some situations it may be preferred to remove the header 32 after the bag 10 has been filled. The embodiment of bag 10 illustrated in FIG. 5 includes a line of weakness 44 in the header 32 above the seal 42. After the bag 10 has been filled, the portion of the header 32 above the line of weakness 44 can be removed. This removes any banner and any handles but the presence of the header 32 before filling allows the use of existing filling and sealing equipment with no or little modification to existing equipment.

Figure 6:
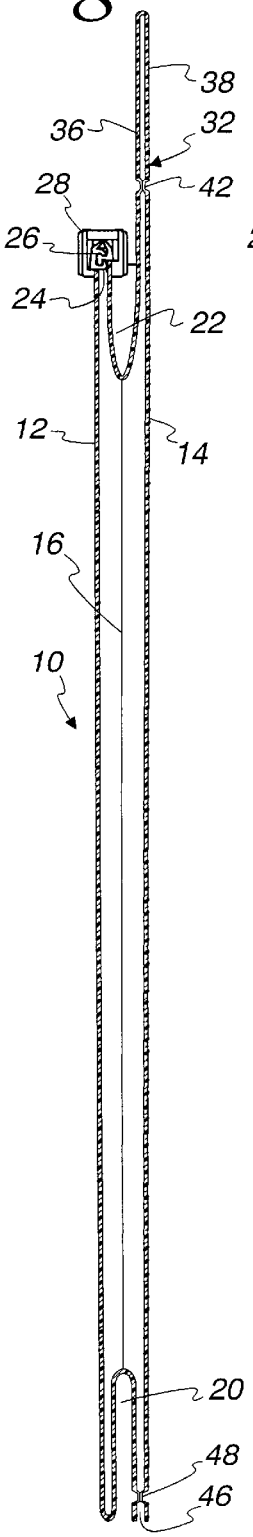
FIG. 6 is a view similar to FIG. 2 illustrating a seal in the bag after bottom filling.
Figure 7:
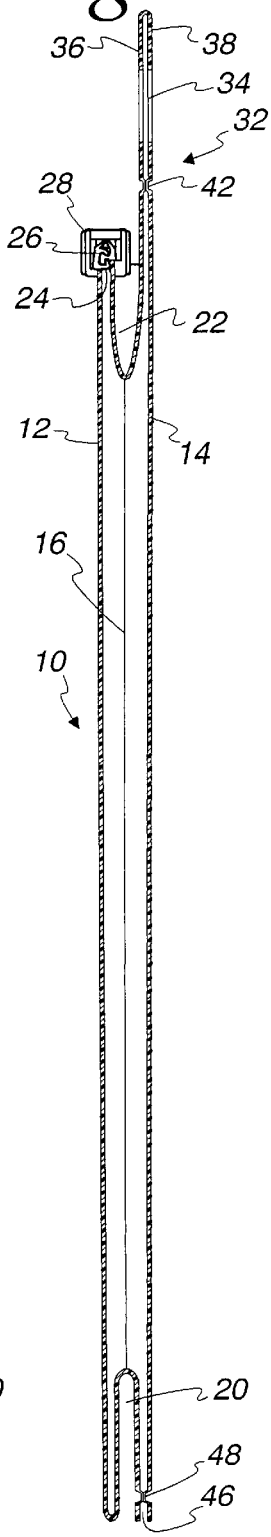
FIG. 7 is a view similar to FIG. 6 illustrating a handle in the bag.

The bag 10 may also be bottom filled. The embodiment of bag 10 in FIG. 6 illustrates the bottom gusset 20 including an open end 46 through which the bag 10 may be filled with product. The top 10 of header 32 is closed either by sealing or as a continuous portion of the header 32. After the bag 10 is filled, the bottom gusset 20 is sealed at seal 48 located above the open end 46. This bottom filled bag 10 also may include handles 34 in the header 32 (FIG. 7).

Figure 8:
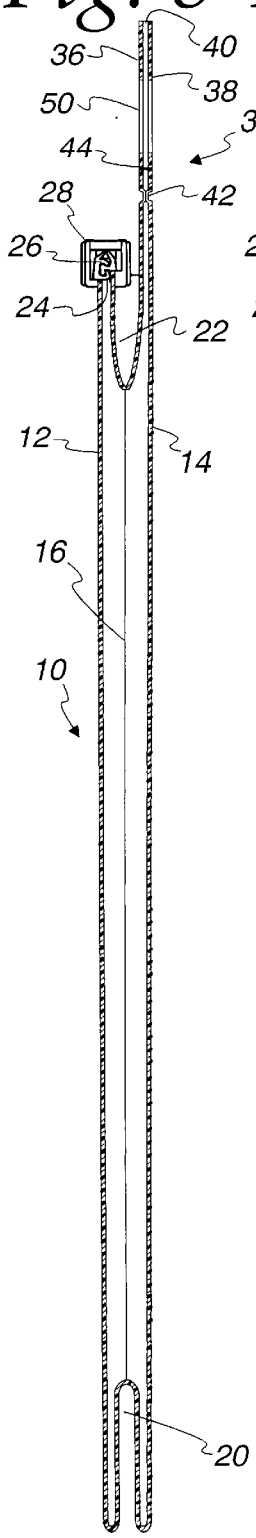
FIG. 8 is a view similar to FIG. 5 with wicket holes.

In some filling and sealing equipment and in some uses of the bags 10, wicket holes 50 (FIGS. 8 and 9) in the header 32 are desired for holding the bag 10. FIG. 8 illustrates a top fill bag 10 with an open top 40 of header 32 for filling. This bag 10 includes wicket holes 50. The header 32 may be removed after filling and therefore includes a line of weakness 44 above the seal 42 and below the wicket holes 50. Thus, the wicket holes 50 in this bag are intended for handling the bag in the filling and sealing equipment.

Figure 9:
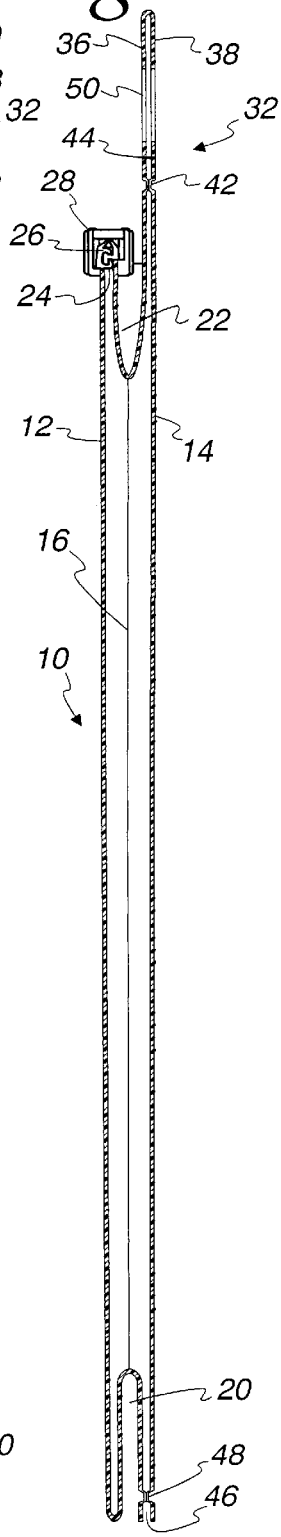
FIG. 9 is a view similar to FIG. 6 with wicket holes and a line of weakness to remove a header.

The bag 10 illustrated in FIG. 9 is similar to the bag of FIG. 8 except that the bag 10 in FIG. 9 is a bottom fill bag. The top 40 of the header 32 is not open. Instead, the bottom gusset 20 has the open end 46 in the peak 20B that is sealed by seal 48 after the bag 10 is filled.

Figure 10:
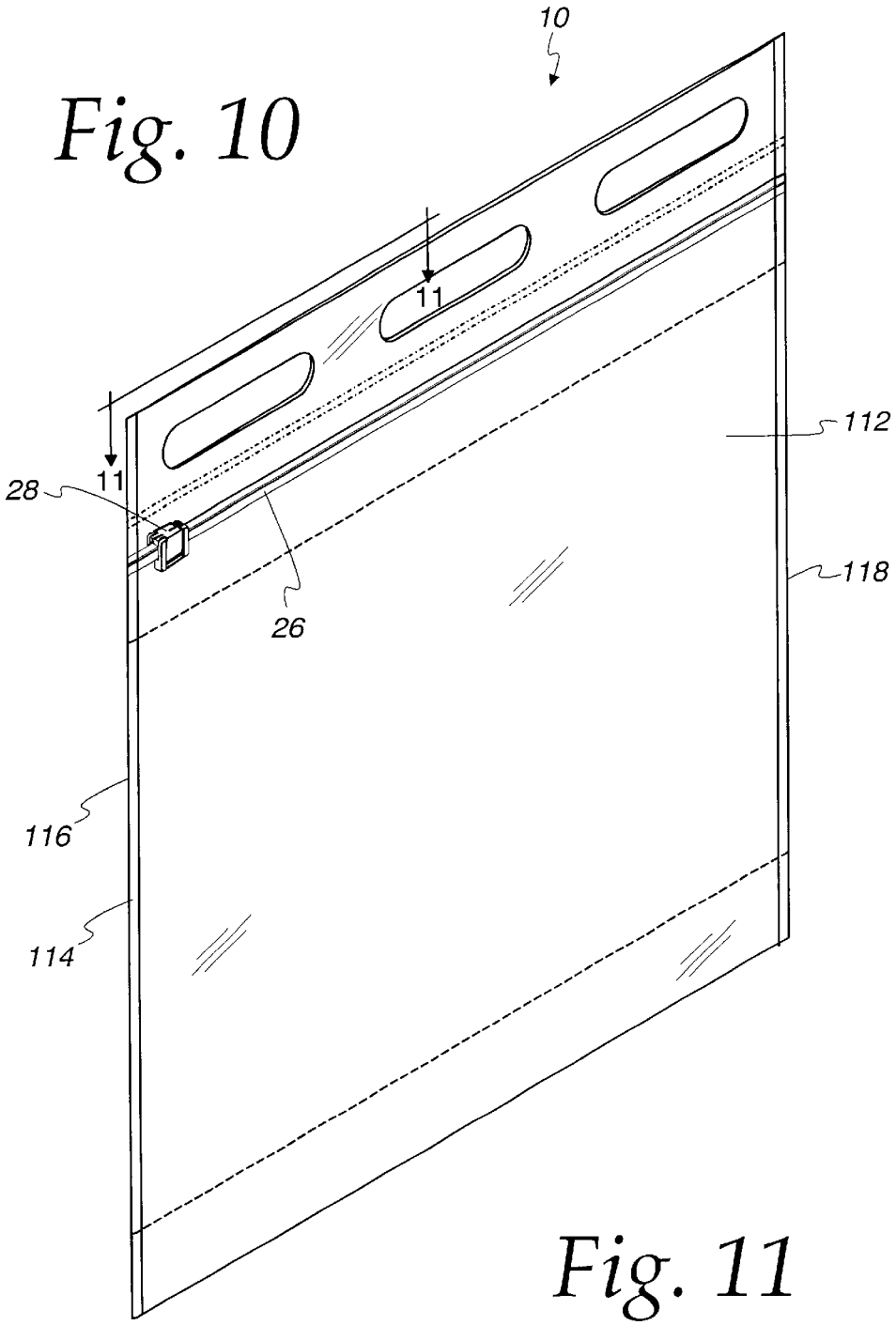
FIG. 10 is a perspective view of a bag with an alternate embodiment of a termination for a closure in the bag.
Figure 11:
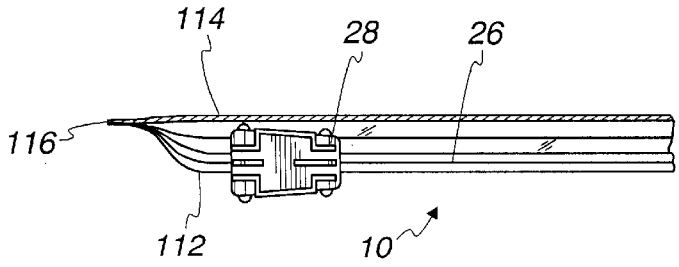
FIG. 11 is a view taken along line 11—11 in FIG. 10.

As previously mentioned, travel of the slider 28 is confined to the closure 26 by clips 30 in FIGS. 1–9. Travel of the slider 28 may also be confined by sealing the ends of the closure 26. With specific reference to FIGS. 10–11, a bag 110 is illustrated that is the same as bag 10 with the exception that a front panel 112 and a back panel 114 are sealed together at sides 116 and 118 sealing all the layers of the bag 110 at the sides 116 and 118. By sealing all layers of the bag 110 at the ends of the closure 26 a termination at each end of the closure 26 is provided. That is, travel of the slider 28 is stopped upon reaching the sealed ends of the closure 26.

While the present invention has been described with reference to one or more particular embodiments, those skilled in the art will recognize that many changes may be made thereto without departing from the spirit and scope of the present invention. Each of these embodiments and obvious variations thereof is contemplated as falling within the spirit and scope of the claimed invention, which is set forth in the following claims.

What is claimed is:

1. A bag, comprising:

a front panel, a back panel, said front panel and said back panel having first and second sides, said first and second sides being sealed to form a bag, said bag having a top and a bottom, a mouth in said bag, a reclosable closure in said mouth, a slider on said reclosable closure, and a first gusset in said top, a second gusset in said bottom, and an opening in one of said first and second gussets for filling said bag, said opening being spaced from said mouth.

2. The bag claimed in claim 1 comprising a header on one of said first and second gussets.

3. The bag claimed in claim 1 comprising a header on one of said first and second gussets and a handle in said header.

4. The bag claimed in claim 1 comprising a header on one of said first and second gussets and a wicket hole in said header.

5. The bag claimed in claim 1 comprising a header on one of said first and second gussets and a line of weakness in said header.

6. The bag claimed in claim 1 wherein said mouth and closure are in said first gusset, said first gusset is sealed with said front and back panels at said first and second sides at the ends of said closure.

7. The bag claimed in claim 1 comprising a slider on said closure, said closure including first and second ends, said first and second ends of said closure terminated by seals in said first gusset and said front and back panels.

8. A bag comprising:

a first panel and a second panel, said first and second panels including first and second sides and a bottom to define a bag, an opening, one of said first panel and said second panel for filling said bag, a mouth in one of said first panel and said second panel, said mouth spaced from said opening, a reclosable closure in said mouth, a first gusset in said bag, a second gusset in said bag, and a header on one of said first gusset and said second gusset, wherein said opening is in said header.

9. The bag claimed in claim 8 wherein said opening is in one of said first and second gussets.

10. The bag claimed in claim 8 comprising a handle in said header.

11. The bag claimed in claim 8 wherein the reclosable closure includes a slider.

12. The bag claimed in claim 8 wherein said header is removable from said bag.

13. The bag claimed in claim 8 said reclosable closure including first and second ends each terminated by seals in said first gusset and said first and second panels.

14. A bag, comprising:

a front panel, a back panel, said front panel and said back panel having first and second sides, said first and second sides being sealed to form a bag, said bag having a top and a bottom, a mouth in said bag, a reclosable closure in said mouth, a slider on said reclosable closure, a first gusset in said bottom, and an opening spaced from said mouth in said first gusset for filling said bag, and a second gusset in said top, said mouth being in said second gusset.

15. The bag claimed in claim 14 comprising a header on said second gusset.

16. The bag claimed in claim 14 comprising a header on said second gusset and a handle in said header.

17. The bag claimed in claim 14 comprising a header on said second gusset and a wicket hole in said header.

18. The bag claimed in claim 14 comprising a header on said second gusset and a line of weakness in said header.

19. The bag claimed in claim 14 said first gusset being sealed at said first and second sides to form terminations in said closure.

20. A bag, comprising:

a front panel, a back panel, said front panel and said back panel having first and second sides, said first and second sides being sealed to form a bag, said bag having a top and a bottom, a mouth in said bag, a reclosable closure in said mouth, and a first gusset in said top, a second gusset in said bottom, and an opening in one of said first and second gussets for filling said bag, said opening being spaced from said mouth; wherein said; mouth and said reclosable closure being in said first gusset.

* * * * *